US008771398B2

(12) United States Patent
Minor

(10) Patent No.: US 8,771,398 B2
(45) Date of Patent: Jul. 8, 2014

(54) NICKEL BRAZE ALLOY COMPOSITION

(75) Inventor: Michael Minor, Arlington, TX (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/590,252

(22) Filed: Aug. 21, 2012

(65) Prior Publication Data

US 2012/0308427 A1 Dec. 6, 2012

Related U.S. Application Data

(62) Division of application No. 12/362,710, filed on Jan. 30, 2009, now Pat. No. 8,273,148.

(51) Int. Cl.
*B22F 1/00* (2006.01)
*C22C 19/05* (2006.01)

(52) U.S. Cl.
USPC ..... 75/255; 420/443; 420/445; 420/460

(58) Field of Classification Search
USPC ..... 75/252, 255; 148/428; 228/262.31
See application file for complete search history.

(56) References Cited

U.S. PATENT DOCUMENTS

| | | | |
|---|---|---|---|
| 3,817,719 | A | 6/1974 | Schilke et al. |
| 4,585,481 | A | 4/1986 | Gupta |
| 4,725,509 | A | 2/1988 | Ryan |
| 5,066,459 | A | 11/1991 | Beltran et al. |
| 5,182,080 | A | 1/1993 | Beltran et al. |
| 5,240,491 | A | 8/1993 | Budinger |
| 5,320,690 | A | 6/1994 | Beltran et al. |
| 5,561,827 | A | 10/1996 | Reeves et al. |
| 5,628,814 | A | 5/1997 | Reeves |
| 5,780,116 | A | 7/1998 | Sileo |
| 5,902,421 | A | 5/1999 | Christy |
| 6,200,690 | B1 | 3/2001 | Rabinkin |
| 6,530,971 | B1 | 3/2003 | Cohen et al. |
| 7,017,793 | B2 | 3/2006 | Kinstler |
| 7,278,828 | B2 | 10/2007 | Steplewski et al. |
| 7,279,229 | B2 | 10/2007 | Budinger et al. |
| 8,075,662 | B2 | 12/2011 | Minor |
| 2006/0081685 | A1 | 4/2006 | Kinstler |
| 2006/0081686 | A1 | 4/2006 | Kinstler |
| 2010/0196193 | A1 | 8/2010 | Minor |

FOREIGN PATENT DOCUMENTS

| | | |
|---|---|---|
| CN | 101314853 | 12/2008 |
| EP | 1391531 | 2/2004 |
| EP | 1783237 | 5/2007 |
| EP | 1806418 | 7/2007 |
| EP | 1837104 | 9/2007 |
| EP | 1859880 | 11/2007 |
| EP | 2113333 | 11/2009 |
| WO | 2004016819 | 2/2004 |

OTHER PUBLICATIONS

Partial European Search Reported dated Nov. 2, 2010.
European Search Reported dated Aug. 22, 2011.

*Primary Examiner* — George Wyszomierski
*Assistant Examiner* — Ngoclan T Mai
(74) *Attorney, Agent, or Firm* — Calson, Gaskey & Olds, P.C.

(57) ABSTRACT

An alloy composition includes a blend of a first alloy and a second, different alloy. The blend has a combined composition including about 17.2 wt %-24.25 wt % of chromium, about 6 wt %-10.51 wt % of aluminum, about 3 wt %-23 wt % of cobalt, about 1.5 wt %-3.6 wt % of silicon, about 0.1 wt %-0.175 wt % of boron, up to about 0.163 wt % of hafnium, about 0.075 wt %-0.7 wt % of yttrium, and a balance of nickel.

12 Claims, 1 Drawing Sheet

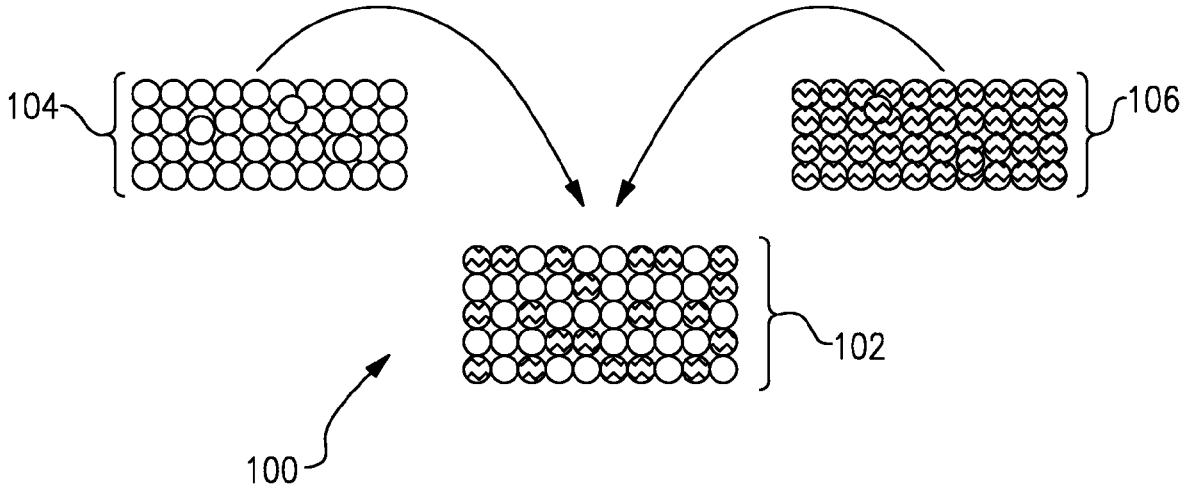
104
106
102
100

NICKEL BRAZE ALLOY COMPOSITION

RELATED APPLICATION

The present invention is a division of U.S. patent application Ser. No. 12/362,710, filed Jan. 30, 2009.

BACKGROUND OF THE INVENTION

This disclosure relates to alloy compositions and, more particularly, to a nickel alloy composition that provides enhanced environmental resistance.

Nickel braze alloys are commonly used for abradable coatings on nickel alloy substrates, such as gas turbine engine components. For example, nickel braze alloys used as original coatings or for coating repair may include a mixture of a high melting point nickel alloy and a lower melting point nickel alloy having a different composition. The nickel braze alloy may be applied in a repair process to worn and/or damaged areas of the substrate and then heated to a brazing temperature to wet the surfaces and flow into any pores or cracks. Upon cooling, the nickel braze alloy forms a composition that is a combination of the high melting point nickel alloy and the lower melting point nickel alloy.

One drawback of at least some known nickel braze alloys is reduced environmental resistance compared to the nickel alloy substrate. For instance, the nickel alloy of the substrate forms an oxide scale that functions as an oxygen barrier to protect the underlying nickel alloy substrate from corrosion. However, the different composition of the nickel braze alloy may form an oxide scale that is unstable or prone to spalling. Consequently, the nickel braze alloy may not be capable of providing a substantially equivalent degree of corrosion protection as the nickel alloy substrate.

SUMMARY OF THE INVENTION

An example alloy composition includes a blend of a first alloy and a second alloy. The first alloy has a first composition that includes about 17 wt %-25 wt % of chromium, about 6 wt %-12.5 wt % of aluminum, about 18 wt %-22 wt % of cobalt, up to 4 wt % of tantalum, up to about 8 wt % of tungsten, up to about 0.4 wt % of silicon, about 0.25 wt %-1 wt % of hafnium, about 0.1 wt %-1 wt % of yttrium, and a balance of nickel. The second alloy has a second composition including about 21.25 wt %-22.75 wt % of chromium, about 5.7 wt %-6.3 wt % of aluminum, about 11.5 wt %-12.5 wt % of cobalt, about 5.7 wt %-6.3 wt % of silicon, boron in an amount no greater than 1.0 wt %, and a balance of nickel.

In another aspect, an example alloy composition includes a blend of a first alloy and a second, different alloy. The blend includes a combined composition of about 17.2 wt %-24.25 wt % of chromium, about 6 wt %-10.51 wt % of aluminum, about 3 wt %-23 wt % of cobalt, about 1.5 wt %-3.6 wt % of silicon, about 0.1 wt %-0.175 wt % of boron, up to about 0.163 wt % of hafnium, about 0.075 wt %-0.7 wt % of yttrium, and a balance of nickel.

BRIEF DESCRIPTION OF THE DRAWINGS

The various features and advantages of the disclosed examples will become apparent to those skilled in the art from the following detailed description. The drawings that accompany the detailed description may be briefly described as follows.

FIG. 1 illustrates an example alloy composition that includes a blend of a first alloy and a second alloy.

DETAILED DESCRIPTION OF THE PREFERRED EMBODIMENT

FIG. 1 illustrates an example alloy composition 100 for use as a nickel braze abradable coating, for example. The alloy composition 100 may also be used in other applications, such as protective coatings or as a repair material for dimensional restoration or crack repair. The alloy composition 100 may be deposited as a coating on a nickel alloy substrate, such as a gas turbine engine outer air seal located radially outwards of the turbine blades. As will be described, the alloy composition 100 provides enhanced environmental resistance.

The alloy composition 100 includes a blend 102 of a first alloy 104 and a second alloy 106. The first alloy 104 and the second alloy 106 are schematically shown as distinct powders; however, the first alloy 104 and the second alloy 106 may be in the form of distinct wires, powder slurries, or other distinct forms that are suitable for a brazing process. The distinct powders include individual particles of each of the first alloy 104 and the second alloy 106.

The first alloy 104 may be a high melting temperature alloy and the second alloy 106 may be a low melting temperature alloy relative to the high melting temperature first alloy. That is, the first alloy 104 has a different chemical composition than the second alloy 106 such that the melting temperatures are different. For instance, the first alloy 104 may have a composition that is equivalent to the composition of the substrate onto which the blend 102 will be deposited.

The first alloy 104 may include little or no boron and the second alloy 106 may include boron in an amount no greater than 1.0 wt %. In one example, the second alloy 106 may include about 0.45 wt %-0.55 wt % of boron. Boron contributes to lowering the melting temperature of nickel alloys but may be detrimental to forming a stable oxide scale for corrosion resistance. Thus, using the relatively low level of boron in the second alloy 106 provides the benefit of a lower melting temperature for a brazing process. Once the first alloy 104 and the second alloy 106 melt and mix in the brazing process, the composite composition of the blend 102 is relatively low in boron and capable of forming a stable oxide scale that functions as an oxygen barrier for enhanced environmental resistance.

The first alloy 104 and the second alloy 106 may be selected from a variety of different compositions to achieve enhanced environmental resistance. For example, the first alloy 104 has a first composition that may include about 17 wt %-25 wt % of chromium, about 6 wt %-12.5 wt % of aluminum, about 18 wt %-22 wt % of cobalt, up to 4 wt % of tantalum, up to about 8 wt % of tungsten, up to about 0.4 wt % of silicon, about 0.25 wt %-1 wt % of hafnium, about 0.1 wt %-1 wt % of yttrium, and a balance of nickel, and the second alloy has a second composition that may include about 21.25 wt %-22.75 wt % of chromium, about 5.7 wt %-6.3 wt % of aluminum, about 11.5 wt %-12.5 wt % of cobalt, about 5.7 wt %-6.3 wt % of silicon, boron in an amount no greater than 1.0 wt %, and a balance of nickel. The term "about" as used in this description relative to compositions or other values refers to possible variation in the given value, such as normally accepted variations or tolerances in the art.

As may be appreciated, any of the compositions in this disclosure may include other elements. Alternatively, any of the compositions of this disclosure may include only the elements listed in the particular composition. In another alternative, the disclosed compositions may additionally include only impurity elements that do not affect the properties of the alloy, such as oxidation tendencies, or elements that are unmeasured or undetectable in the alloy.

In further examples, the first alloy 104 may be any of the example compositions 1-6 in Table I below, and the second nickel alloy 106 may be the example composition 7 in Table I. In composition 1, the tungsten and tantalum contribute to strengthening the alloy composition 100 once the first alloy 104 and the second alloy 106 mix in a brazing process.

TABLE I

| | First Alloy Powder Composition (wt %) | | | | | | Second Alloy Powder Composition (wt %) |
|---|---|---|---|---|---|---|---|
| Element | 1 | 2 | 3 | 4 | 5 | 6 | 7 |
| Cr | 25 | 22 | 17 | | 23 | 22 | 22 |
| Al | 6 | 10 | 12.5 | 10 | 6 | 9.1 | 6 |
| Co | — | — | 22 | 75 | — | 18 | 12 |
| Ta | 4 | — | — | — | — | — | — |
| W | 8 | — | — | — | — | — | — |
| Si | — | — | 0.4 | 15 | — | — | 6 |
| B | — | — | — | — | — | — | 0.5 |
| Hf | 1 | — | 0.25 | — | — | — | — |
| Y | 0.1 | 1 | 0.6 | — | 0.5 | 0.17 | — |
| Ni | Bal. | Bal. | Bal. | — | Bal. | Bal. | Bal. |

The blend 102 may include a predetermined amount of the first alloy 104 and a predetermined amount of the second alloy 106 to achieve a desired combined alloy composition. The blend 102 may exclusively include the first alloy 104 and the second alloy 106 such that the sum of the predetermined amounts totals 100 wt %. In other examples, the blend 102 may include a binder material in addition to the first alloy 104 and the second alloy 106. In further examples, the blend 102 may include other constituents, but the second alloy may be about 10 wt %-40 wt % of the total weight of the blend 102.

The blend 102 may have a variety of different combined alloy compositions, depending on the blend ratio and compositions of the first alloy 104 and the second alloy 106. Additionally, the blend 102 may include at least one additional alloy having a composition within the broad range of the first composition but different than the selected first alloy 104. The combined alloy composition of the blend 102 may include about 17.2 wt %-24.25 wt % of chromium, about 6 wt %-10.51 wt % of aluminum, about 3 wt %-23 wt % of cobalt, about 1.5 wt %-3.6 wt % of silicon, about 0.1 wt %-0.17 wt % of boron, up to about 0.163 wt % of hafnium, about 0.075 wt %-0.7 wt % of yttrium, and a balance of nickel.

In further examples, the combined alloy composition of the blend 102 may be any of the example compositions 8-19 in Tables II and Tables III below.

TABLE II

| | Combined Alloy Powder Composition (wt %) | | | | | |
|---|---|---|---|---|---|---|
| Element | 8 | 9 | 10 | 11 | 12 | 13 |
| Cr | 24.25 | 22 | 19.5 | 17.2 | 17.25 | 21.5 |
| Al | 6 | 8.8 | 9.85 | 10.5 | 8.875 | 7.75 |
| Co | 3 | 3.6 | 15.2 | 22.9 | 21.35 | 12 |
| Ta | 3 | — | — | — | — | — |
| W | 6 | — | — | — | — | — |
| Si | 1.5 | 1.8 | 2.3 | 3 | 3.6 | 2.2 |
| B | 0.125 | 0.15 | 0.175 | 0.14 | 0.1 | 0.175 |
| Hf | 0.75 | | 0.125 | 0.163 | 0.088 | 0.036 |
| Y | 0.075 | 0.7 | 0.45 | 0.4 | 0.36 | 0.258 |
| Ni | Bal. | Bal. | Bal. | Bal. | Bal. | Bal. |

TABLE III

| | Combined Alloy Powder Composition (wt %) | | | | | |
|---|---|---|---|---|---|---|
| Element | 14 | 15 | 16 | 17 | 18 | 19 |
| Cr | 21.75 | 19.8 | 22 | 18.75 | 20.85 | 22.75 |
| Al | 8.19 | 9.2 | 8.02 | 10.23 | 7.95 | 6 |
| Co | 16.1 | 9.9 | 15.9 | 18.5 | 10.8 | 3 |
| Ta | — | — | — | — | — | — |
| W | — | — | — | — | — | — |
| Si | 2.12 | 2.7 | 2.1 | 2.36 | 2.22 | 1.5 |
| B | 0.175 | 0.1 | 0.175 | 0.175 | 0.175 | 0.125 |
| Hf | 0.013 | — | — | 0.163 | 0.075 | — |
| Y | 0.132 | 0.7 | 0.11 | 0.39 | 0.355 | 0.375 |
| Ni | Bal. | Bal. | Bal. | Bal. | Bal. | Bal. |

In Tables II and III, composition 8 represents a blend of 75 wt % of composition 1 (Table 1) as the first alloy and 25 wt % of the second alloy 106.

Composition 9 represents a blend of 70 wt % of composition 2 as the first alloy 104 with 30 wt % of the second alloy 106.

Composition 10 represents a blend of 15 wt % of composition 2 as the first alloy 104, 35 wt % of the second alloy 106, and 50 wt % of composition 3 as another alloy.

Composition 11 represents a blend of 65 wt % of composition 3 as the first alloy 104, 28 wt % of the second alloy 106, and 7 wt % of composition 4 as another alloy.

Composition 12 represents a blend of 30 wt % of composition 5 as the first alloy 104, 20 wt % of the second alloy 106, and 35 wt % of composition 3 and 15 wt % of composition 4 additional alloys.

Composition 13 represents a blend of 15 wt % of composition 3 as the first alloy 104, 35 wt % of the second alloy 106, and 25 wt % of composition 5 and 25 wt % of composition 6 as additional alloys.

Composition 14 represents a blend of 5 wt % of composition 3 as the first alloy 104, 35 wt % of the second alloy 106, and 60 wt % of composition 6 as an additional alloy.

Composition 15 represents a blend of 70 wt % of composition 2 as the first alloy 104, 20 wt % of the second alloy 106, and 10 wt % of composition 4 as an additional alloy.

Composition 16 represents a blend of 65 wt % of composition 6 as the first alloy 104 and 35 wt % of the second alloy 106.

Composition 17 represents a blend of 65 wt % of composition 3 as the first alloy 104 and 35 wt % of the second alloy 106.

Composition 18 represents a blend of 30 wt % of composition 3 as the first alloy 104, 35 wt % of the second alloy 106, and 35 wt % of composition 5 as an additional alloy.

Composition 19 represents a blend of 75 wt % of composition 5 as the first alloy and 25 wt % of the second alloy 106.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure may only be determined by studying the following claims.

What is claimed is:

1. An alloy composition comprising:

a blend of a first alloy and a second, different alloy, the blend consisting of 24.25 wt % of chromium, 6 wt % of aluminum, 3 wt % of cobalt, 3 wt % of tantalum, 6 wt % of tungsten, 1.5 wt % of silicon, 0.125 wt % of boron, 0.75 wt % of hafnium, 0.075 wt % of yttrium, and the balance of nickel.

2. An alloy composition comprising:

a blend of a first alloy and a second, different alloy, the blend having a combined composition consisting of 22 wt % of chromium, 8.8 wt % of aluminum, 3.6 wt % of cobalt, 1.8wt% of silicon, 0.15 wt % of boron, 0.7 wt % of yttrium, and the balance of nickel.

3. An alloy composition comprising:

a blend of a first alloy and a second, different alloy, the blend having a combined composition consisting of 19.5 wt % of chromium, 9.85 wt % of aluminum, 15.2 wt % of cobalt, 2.3 wt % of silicon, 0.175 wt % of boron, 0.125 wt % of hafnium, 0.45 wt % of yttrium, and the balance of nickel.

4. An alloy composition comprising:

a blend of a first alloy and a second, different alloy, the blend having a combined composition consisting of 17.2 wt % of chromium, 10.5 wt % of aluminum, 22.9 wt % of cobalt, 3 wt % of silicon, 0.14 wt % of boron, 0.163 wt % of hafnium, 0.4 wt % of yttrium, and the balance of nickel.

5. An alloy composition comprising:

a blend of a first alloy and a second, different alloy, the blend having a combined composition consisting of 17.25 wt % of chromium, 8.875 wt % of aluminum, 21.35 wt % of cobalt, 3.6 wt % of silicon, 0.1 wt % of boron, 0.088 wt % of hafnium, 0.36 wt % of yttrium, and the balance of nickel.

6. An alloy composition comprising:

a blend of a first alloy and a second, different alloy, the blend having a combined composition consisting of 21.5 wt % of chromium, 7.75 wt % of aluminum, 12 wt % of cobalt, 2.2 wt % of silicon, 0.175 wt % of boron, 0.036 wt % of hafnium, 0.258 wt % of yttrium, and the balance of nickel.

7. An alloy composition comprising:

a blend of a first alloy and a second, different alloy, the blend having a combined composition consisting of 21.75 wt % of chromium, 8.19 wt % of aluminum, 16.1 wt % of cobalt, 2.12 wt % of silicon, 0.175 wt % of boron, 0.013 wt % of hafnium, 0.132 wt % of yttrium, and the balance of nickel.

8. An alloy composition comprising:

a blend of a first alloy and a second, different alloy, the blend having a combined composition consisting of 19.8 wt % of chromium, 9.2 wt % of aluminum, 9.9 wt % of cobalt, 2.7 silicon, 0.1 wt % of boron, 0.7 wt % of yttrium, and the balance of nickel.

9. An alloy composition comprising:

a blend of a first alloy and a second, different alloy, the blend having a combined composition consisting of 18.75 wt % of chromium, 10.23 wt % of aluminum, 18.5 wt % of cobalt, 2.36 wt % of silicon, 0.175 wt % of boron, 0.163 wt % of hafnium, 0.39 wt % of yttrium, and the balance of nickel.

10. An alloy composition comprising:

a blend of a first alloy and a second, different alloy, the blend having a combined composition consisting of 20.85 wt % of chromium, 7.95 wt % of aluminum, 10.8 wt % of cobalt, 2.22 wt % of silicon, 0.175 wt % of boron, 0.075 wt % of hafnium, 0.355 wt % of yttrium, and the balance of nickel.

11. An alloy composition comprising:

a blend of a first alloy and a second, different alloy, the blend having a combined composition consisting of 22.75 wt % of chromium, 6 wt % of aluminum, 3 wt % of cobalt, 1.5 wt % of silicon, 0.125 wt % of boron, 0.375 wt % of yttrium, and the balance of nickel.

12. An alloy composition comprising:

a blend of a first alloy and a second, different alloy, the blend having a combined composition including about 17.2 wt %-24.25 wt % of chromium, about 6 wt %-10.51 wt % of aluminum, about 3 wt %-23 wt % of cobalt, about 1.5 wt %-3.6 wt % of silicon, about 0.1 wt %-0.175 wt % of boron, about 0.075 wt %-0.7 wt % of yttrium, 0.013 wt %-0.088 wt % of hafnium, and a balance of nickel.

* * * * *